US006102358A

United States Patent [19]

McLeary

[11] Patent Number: 6,102,358

[45] Date of Patent: Aug. 15, 2000

[54] COUNTERPOISE AND MOUNTING CLAMP FOR A MUSICAL DRUM

[76] Inventor: Joseph Butler McLeary, 4943 Alrose Ave., Memphis, Tenn. 38117

[21] Appl. No.: 08/963,185

[22] Filed: Nov. 3, 1997

[51] Int. Cl.[7] ..... G10D 13/02

[52] U.S. Cl. ..... 248/604; 84/411 R; 84/421; 248/634

[58] Field of Search ..... 248/603, 604, 248/560, 634; 84/451, 411 R

[56] References Cited

U.S. PATENT DOCUMENTS

| | | | |
|---|---|---|---|
| 641,901 | 1/1900 | Soistmann | 84/421 X |
| 1,938,799 | 12/1933 | Bourne | 248/603 X |
| 2,433,594 | 12/1947 | Calo | 84/421 |
| 3,780,613 | 12/1973 | Ludwig, Jr. | 84/421 |
| 4,158,980 | 6/1979 | Gauger | 84/421 |
| 4,396,807 | 8/1983 | Brewer | 248/604 |
| 4,779,509 | 10/1988 | Weir | 84/421 |
| 5,337,645 | 8/1994 | Johnston | 84/421 |
| 5,404,786 | 4/1995 | Gatzen | 84/421 |
| 5,600,080 | 2/1997 | Belli | 84/421 |

*Primary Examiner*—Derek J. Berger

[57] ABSTRACT

Two opposing, interactive, and flexible force fields, formed by a flexible, suspension belt, exist within a sphere on opposite sides of it's equatorial plane and are engaged with a cylindrical musical drum by stretching parts of said belt away from the inner wall of an annular frame, to which it is attached, attachment points occurring in the before mentioned equatorial plane, and further into their respective semi-spheres existing on both sides of said plane. A cylindrical musical drum is placed inside the annular frame in such a way that the curved cylindrical shell of the drum exists in both semi-spheres simultaneously and is in parallel relation with the curved wall of the annular frame. The attached belt is stretched and engages a drum circumferentially at a plurality of points on the outer body of the drum near lugs which are attached to it's cylindrical shell. Force created by the attached belt in each semi-sphere pulls the portion of the drum existing therein toward the before mentioned equatorial plane thus toward equal force in an opposite direction from the opposing semi-sphere. A cylindrical musical drum so placed into and engaged with this counterpoise is suspended therein and thereby in a state of equilibrium. The annular frame, with a drum mounted therein, is engaged and/or disengaged with a mounting clamp, which is designed to receive said frame, and which attaches to, or is an integral part of, an external support structure such as a stand or mounting arm.

11 Claims, 9 Drawing Sheets

COUNTERPOISE AND MOUNTING CLAMP FOR A MUSICAL DRUM

BACKGROUND OF THE INVENTION

Much attention has been given recently to the mounting of musical drums and vibrations which can be transferred from a drum to it's supporting structure when the drum is played. Such a transfer of vibration, which can occur with conventional mounts that attach to a drum's outer shell, can create a loss of resonating energy in the drum. In attempts to decrease the transfer of vibration from a drum to it's supporting structure, various mounting devices have been introduced which can be placed between a drum and it's support structure in order to separate and insulate the mounted drum from said structure. Such devices generally attach to an area of a drum other than the drum's resonating shell and, in the process, apply an insulating material of some kind to help reduce the transfer of vibration. My invention offers an application in this area of musical drum mounting; and to my knowledge, no such device is known to exist which offers such an application.

My invention relates to the mounting of a cylindrically shaped musical drum for the purpose of insulating said drum from it's supporting structure in order to create a setting in which the drum may resonate more freely when played thus increasing it's acoustic potential. The scope of the invention is such that a flexible belt, attached to an annular frame, is stretched away from said frame to engage and support a drum therein. The frame, with drum supported therein, is engaged and/or disengaged with a mounting clamp which is designed to receive said frame and may be joined to, or is an integral part of, a supporting structure such as a stand or tom tom arm.

THE PRIOR ART

The prior art shows many applications in which a musical drum can be connected to a supporting structure in ways other than a drum's conventional mount which is usually attached to the drum's cylindrical body, or shell. Such devices generally attach to a drum on or near it's rim, or counter-hoop, and can be joined with a supporting structure via a mounting plate which is generally connected to an engaging frame portion which holds or grips said drum. The purpose of these devices is such as to insulate a drum from it's supporting structure so that the drum may resonate more freely thus increasing the drum's acoustic potential.

Many drum mounting devices designed to insulate a drum from it's supporting structure are somewhat effective, especially in the way they allow a drum to be positioned in a drum set, which requires careful, precise placement of a drum or drums from a supporting member or members, however, many of these mounting devices have a common restriction: Although many devices insulate a drum somewhat, the amount of vibration transfer to external members is more than desirable. Many devices use only a small amount of insulation, generally of a mildly flexible nature, in their application and due to this rather small amount of insulation, many devices still attach to a drum somewhat rigidly resulting in the previously mentioned vibration transfer and lost drum resonation. Additionally, many devices are designed to remain engaged with a drum such that both the drum and device are separated from a supporting structure and placed into a drum case for the purpose of transporting said drum. In doing this, the previously mentioned mounting plate protrudes outward from the outer wall of a cylindrical drum which in turn can interfere with a drum's transporting case, which is commonly cylindrical itself. Examples of such devices can be found in U.S. Pat. No. 5,454,288 (Hoshino-Oct. 3, 1995), U.S. Pat. No. 5,337,645 (Johnston-Aug. 16, 1994), and U.S. Pat. No. 5,520,083 (Falkner, Jr.-May 28, 1996), to name a few.

U.S. Pat. No. 3,780,613 (Ludwig, Jr. Dec. 25, 1973) teaches a suspension for a bass drum in which four separate suspensions are used along a ring-like, tubular frame for the expressed purpose of reducing unwanted rattles in the drum's supporting member or stand when the drum is beaten. Although the transfer of vibration is decreased, application of the device to smaller drum sizes and precise positioning in a trap set or drum kit is not practical and, in fact, is impossible without the use of multiple suspensions in conjunction with specified eye-shaped mounting hooks which attach directly to a drum's shell. Furthermore, the proximity of other drums or instruments is not a concern in this application which involves a single, large, bass drum, generally used in a large orchestral percussion section, rather than a plurality of smaller drums, cymbals, and the like, which are positioned closely together in a drum kit or trap set.

My invention offers a mounting application that can be used on a small to medium size drum to optimize it's resonance potential. A mounting clamp makes placement of the mounted drum into a trap set or drum kit practical such that an annular frame, so engaged with said clamp and with drum mounted therein, extends away from the clamp, thus, away from a supporting structure, to which said clamp is attached. Additionally, the clamp allows a drum, with annular frame engaged therewith, to be separated from it's supporting structure without compromising the drum's cylindrical shape such that both drum and frame may be placed easily into a cylindrical drum case. Furthermore, an extremely flexible insulating material is a major part of the application which effectively supports and significantly insulates a drum from it's supporting structure, and in doing so, said material is not in contact relation with the mounted drum's resonating shell. For these reasons, I believe my invention offers a new and useful application in the art of musical drum mounting.

BRIEF SUMMARY OF THE INVENTION

It is an object of the my invention to provide a mounting apparatus for a small to medium size, cylindrical, musical drum which enhances the drum's acoustical qualities by separating the drum from rigid mounting hardware that can transfer resonant energy away from the drum to a supporting structure thus moderating the drum's acoustic potential.

It is a further object of the my invention to allow such an enhanced drum to be easily placed and positioned in a trap set or drum kit setting where close spacing of multiple drums or instruments is a concern. In addition, a portion of the device may remain attached to a drum such that both the device and drum therewith engaged retain a conventional musical drum's cylindrical shape for which a common cylindrical drum case is designed to fit.

The device consists of a mounting clamp, an annular mounting frame, and a suspension belt. An annular mounting frame is a rigid, cylinder with a fixed diameter which is diametrically larger than a drum to be mounted therein. Said frame is hoop-like in such that it's cylindrical length is considerable less than that of a drum mounted therein.

A suspension belt acts as a flexible membrane between the annular frame and a drum and is connected to the inner wall of the annular frame in spaced relation at a plurality of points there around. Said frame carries a plurality of openings in and around it's wall to accommodate the attachment of a said belt. The belt is elastomeric and flexible to the extent that it nay be stretched out of it's relaxed state. The belt is stretched, from the annular frame to engage a drum circumferentially at points on the outer body of the drum and, in doing so, applies an opposing force to each end of it's cylindrical length. The mounted drum so engaged by this counterpoise is supported in a state of equilibrium thereby.

A mounting clamp is of rigid construction so as to support the weight of the annular frame, suspension belt, and drum supported therein. The main body of the clamp is plate-like and carries an opening for which a screw may be perpendicularly implemented as a means of applying pressure to the annular frame when engaged with the clamp. On one side of the clamp, two identical, arm-like members extend away from it's main body, at generally equal angles, then turn upward thus creating a space between said members and the clamp's main body, in which the annular frame is received, each member carrying a notch along the inner portion thereof for receiving the annular frame. Said frame is placed into the space, for which it is designed to fit, and pressed into and against each inner, notched portion of both outer members simultaneously with pressure from the previously mentioned screw extending from the main body toward the frame. A pressure plate or the like may be used between the mounting screw and the annular frame to protect said frame from being scared or damaged by said screw.

One embodiment allows for the attachment of the before mentioned flexible belt to the annular frame in such a way that the attachment points are centered on the belts width, that is, each of the belt's attachment points is equidistant from the belt's edges. This allows a drum mounted by such an attached belt to be relatively evenly distributed on both sides of the plane of the encircling annular frame.

Another embodiment calls for the flexible belt to be attached at points on it's width which are slightly off-center, with all attachment points there around being between center and edge of the belt. This allows a drum mounted from such an attached belt to be unevenly distributed within the encircling annular frame which in turn allows the annular frame to sit higher or lower in relation to the drum's shell so that annular frames supporting different drums may overlap thus allowing multiple drums to be placed more closely together.

DETAILED DESCRIPTION

Figure 2:
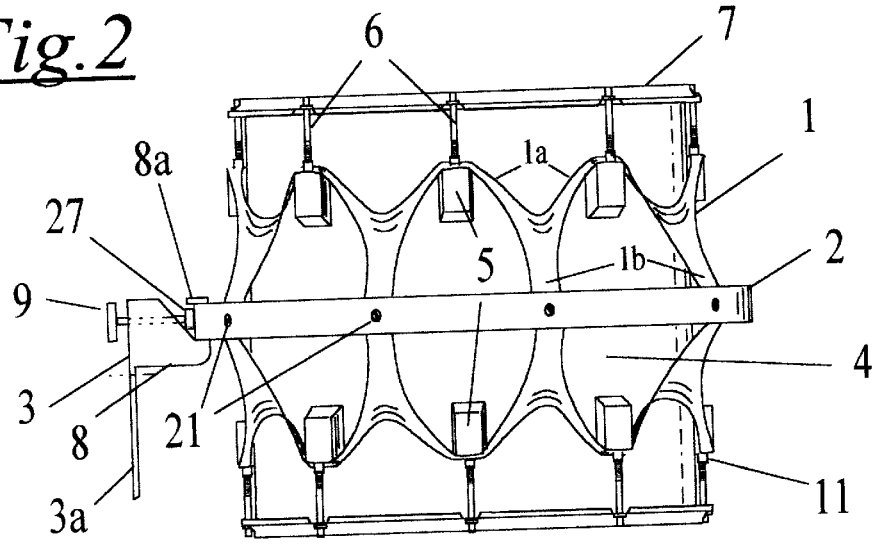
FIG. 2 is a partial, frontal view of my invention and it's application to a musical drum.
Figure 5:
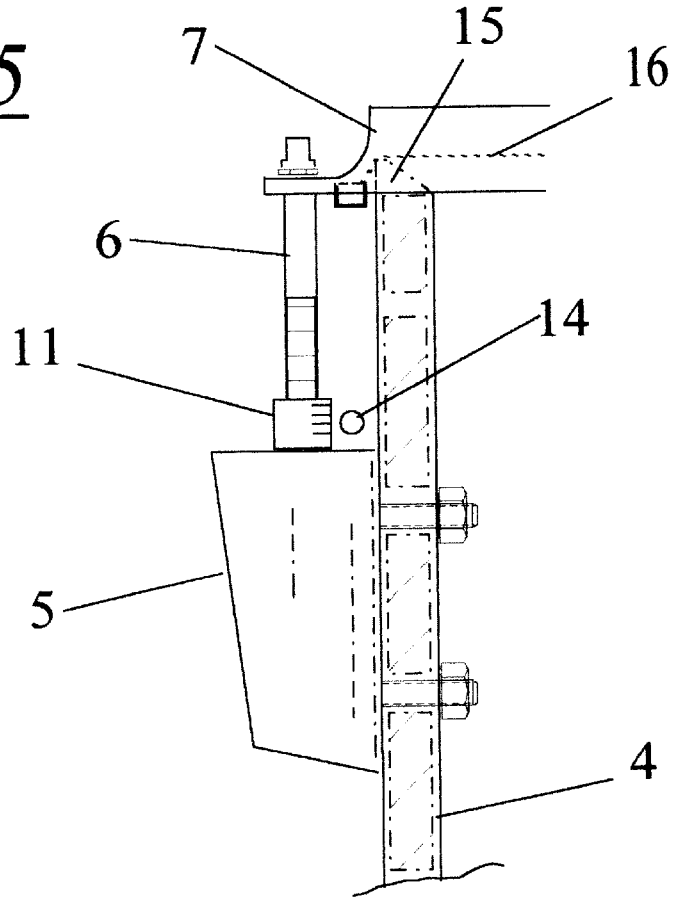
FIG. 5 is a cross sectional view of a drum's shell, with a side perspective of an attached lug and it's outer components.

As can be seen in FIG. 2, my invention applies to a type of musical drum which has a cylindrical shell 4 with a plurality of hardware fixtures, called lugs 5, attached thereto for the purposes of securing drumheads to the openings of said shell via threaded tension rods 6 that engage and apply pressure to a counter hoop 7 which in turn presses a drumhead 16 (not shown) over an opening in a drum's cylindrical shell. Generally, a drum has at least one drumhead secured in this way, but it is common for both cylinder openings of a drum's hollow shell to carry a drumhead. The attachment of a second drumhead is identical in process as the above mentioned. With this type of common hardware configuration, a space occurs on the drum between it's outer shell 4 and tension rods 6. This space 14 is best viewed in FIG. 5 and is an area on a musical drum which my invention engages in such a way that the drum is effectively supported and significantly insulated from it's external support structure.

Figure 4:
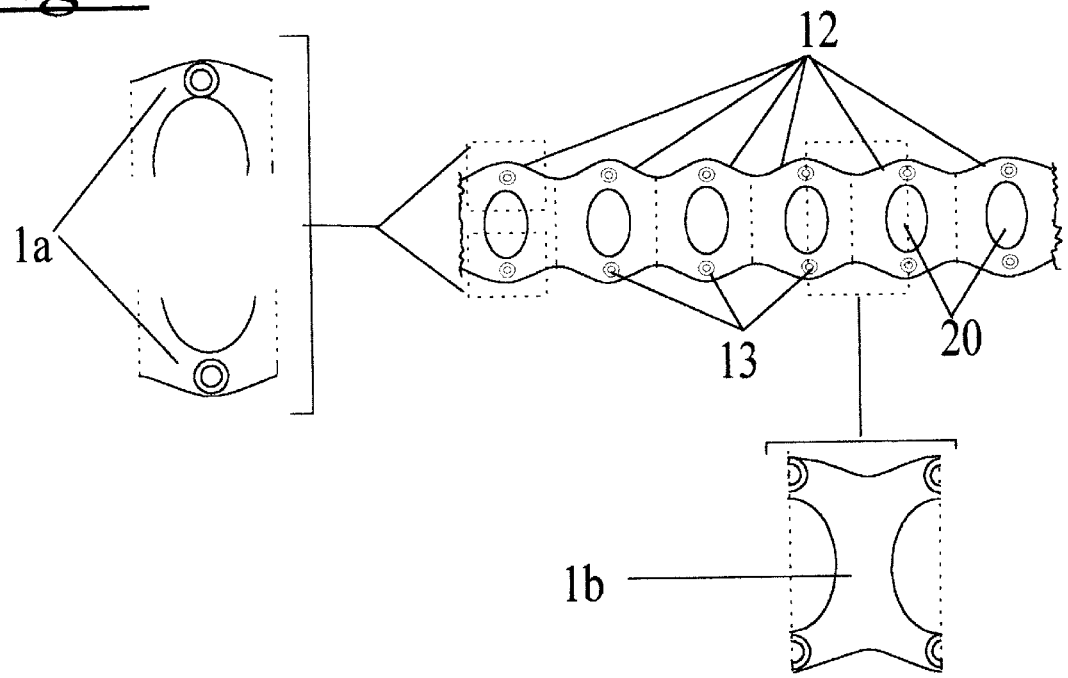
FIG. 4 is a sectional view of the suspension belt showing it's segments and bands contained therein.

A flexible, suspension belt 1 is placed between a drum's shell 4 and an annular mounting frame 2. The belt 1, which is cylindrical in shape, is fashioned in such a way as to carry a series of complete, identical segments 12, as shown in FIG. 4, which are contiguously connected and all of which are interactive in supporting a drum. The size and number of segments in the belt are proportional to the size and number of shell lugs 5 attached to a drum's outer shell 4. Generally, one segment of the belt applies to two opposing shell mounted lugs, which are two lugs 5 on a drum's outer shell, as best shown in FIG. 2, which apply tension to opposite drumheads and are nearest one another.

Figure 10:
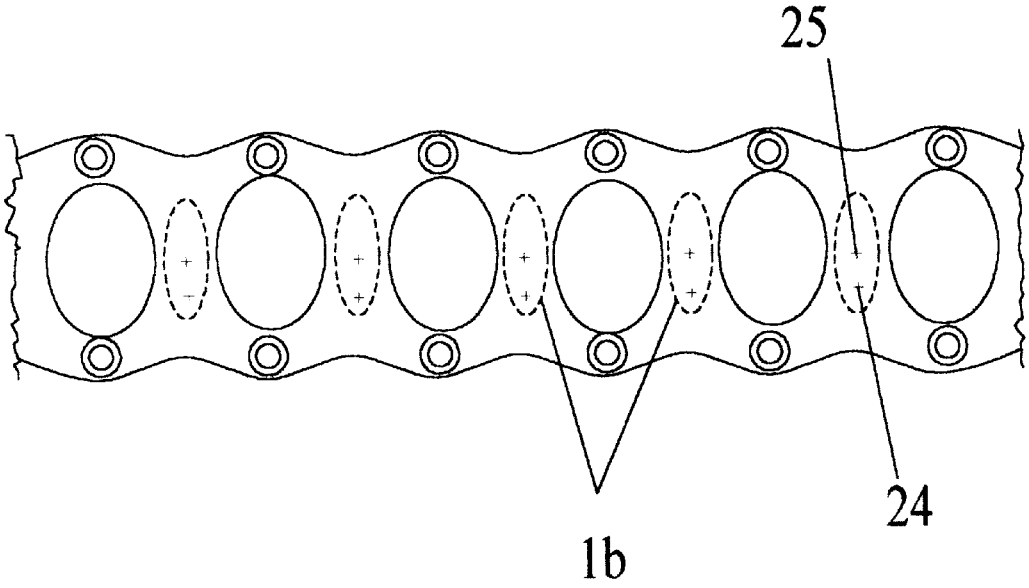
FIG. 10 is a sectional view of the suspension belt, which compliments FIG. 9, showing optional attaching points on the inner bands of the belt.

As shown in FIG. 4, each segment 12 of the belt carries an opening 20 centered therein which separates a set of outer bands 1*a* and inner bands 1*b* within the segment. The outer bands form each of the belt's edges and are connected by the inner bands 1*b*. The inner bands 1*b* of a segment are common to the inner bands of it's adjacent segments. In other words, two adjacent segments intersect at, and are connected by, a single band common to both segments. Each inner band attaches flatly to the inner wall of an annular frame at a centered point 25 on said band as seen in FIG. 10.

Figure 11:
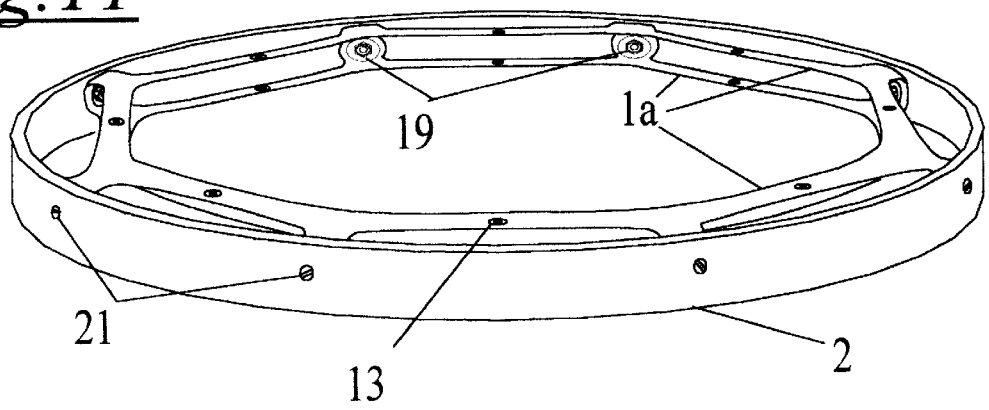
FIG. 11 is an elevated, frontal view of the annular frame and attached suspension belt.
Figure 12:
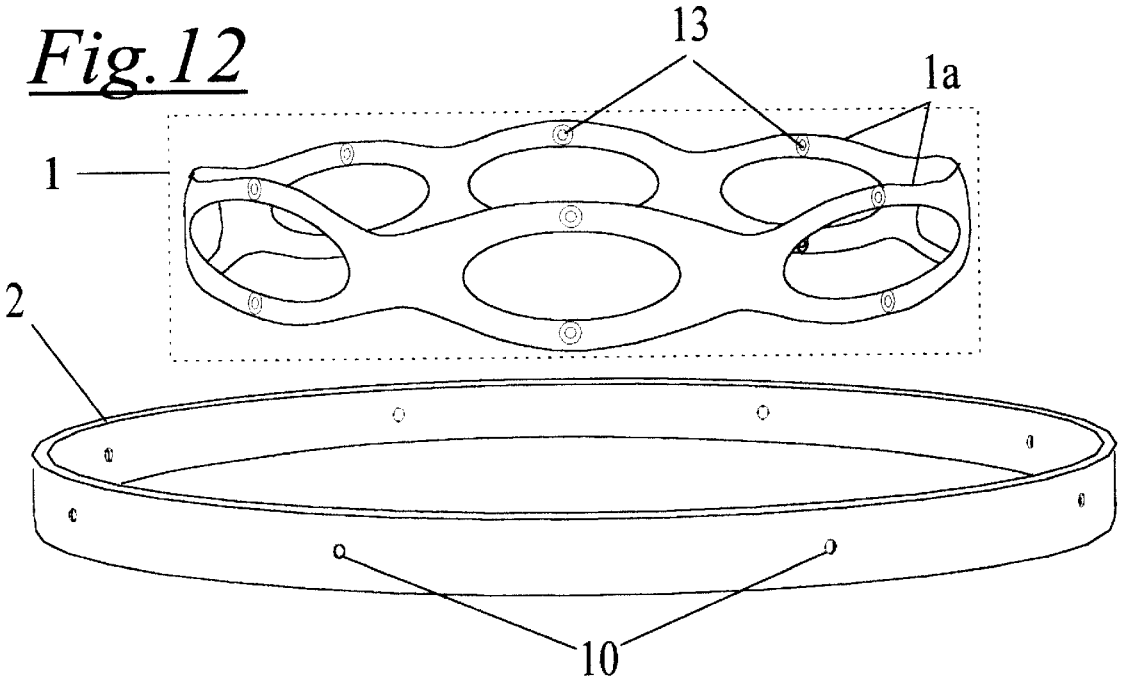
FIG. 12 is an elevated, frontal view of the unattached suspension belt, in a relaxed state, in relation to the annular frame.

The belt 1, which is diametrically smaller in it's relaxed state than the annular frame, as shown in FIG. 12, becomes slightly tensioned when attached to said frame 2, and in doing this the outer bands 1*a* are pulled radially inward and away from the annular frame 2 as shown in FIG. 11. With this tensioning, the combined outer bands of all segments take the shape of two interactive sub-belts each of which resides on an opposite side of a plane determined by the intersection of the belt's attachment points to the annular frame, also seen in FIG. 11.

Figure 3:
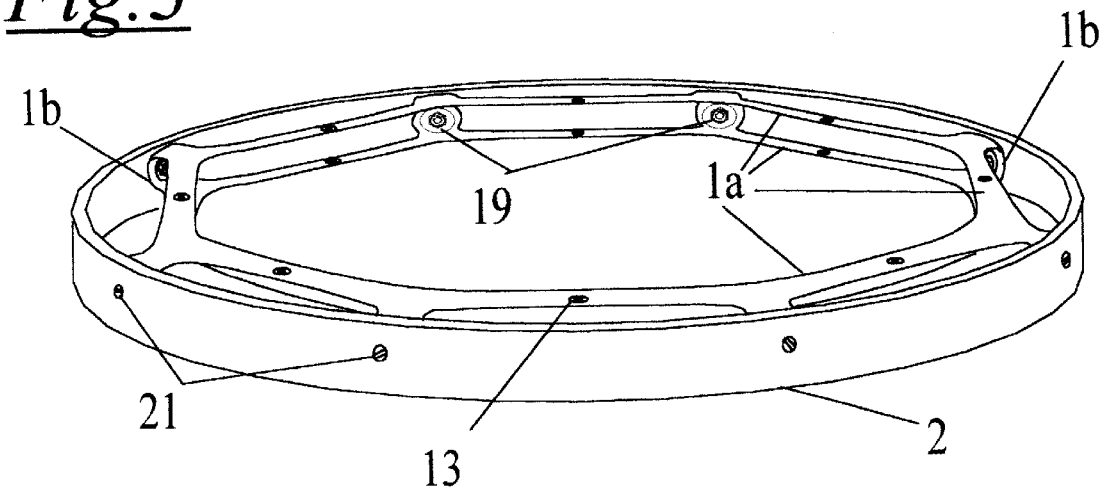
FIG. 3 is an elevated, frontal view of the annular frame, with suspension belt attached, exemplifying the belt's various bands.
Figure 6:
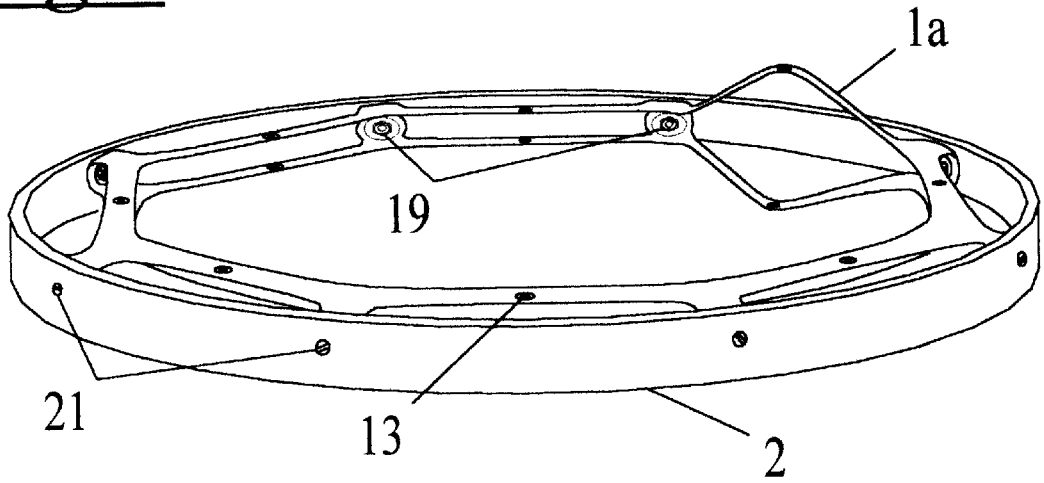
FIG. 6 is an elevated, frontal view of the annular frame and attached suspension belt showing one of the belt segment's outer bands stretched as they would engage opposing lugs on a drum's outer shell.
Figure 13:
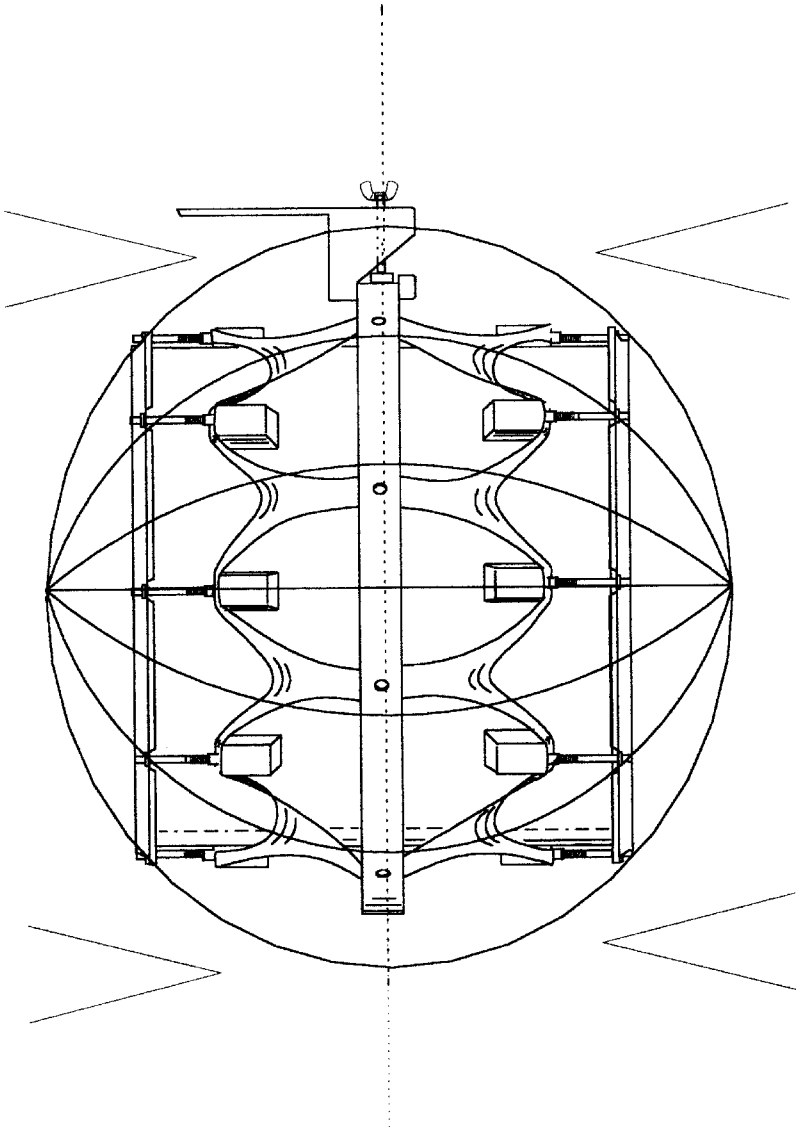
FIG. 13 is a partial, frontal view, similar to FIG. 2, which represents the forces exerted by the suspension belt on a drum which, in turn, is a counterpoise for said forces.
Figure 17:
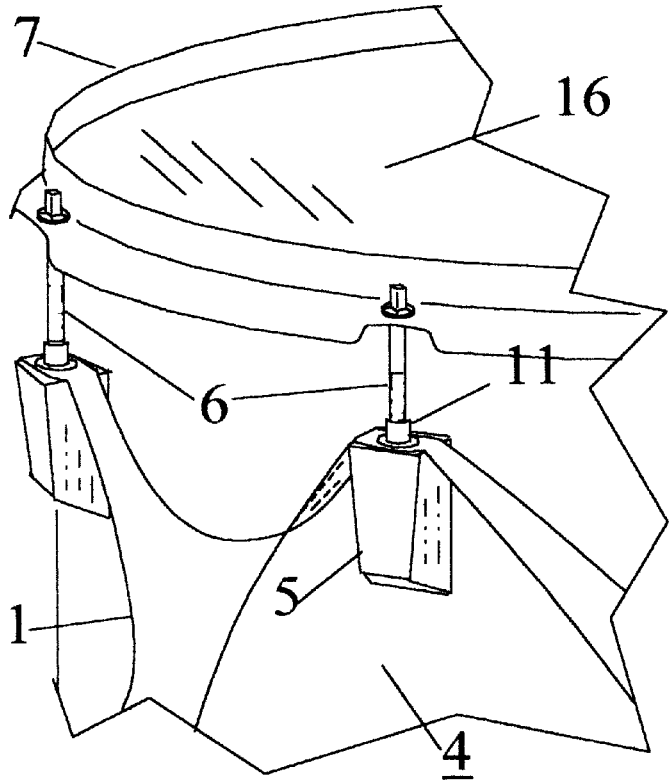
FIG. 17 is an elevated, frontal, sectional view of the suspension belt's outer bands engaging a drum's shell lugs.
Figure 18:
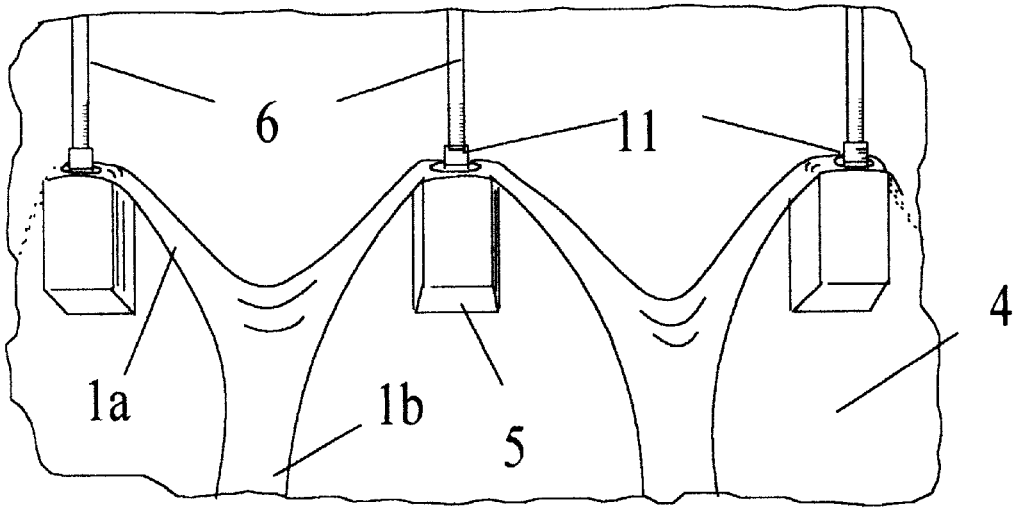
FIG. 18 is a frontal, sectional view of the suspension belt's outer bands engaging a drum's shell lug.

A drum is placed inside the annular frame 2 so that the drum's cylindrical shell is circumferentially encircled by, and in parallel relation with, said frame. Each outer band 1*a* engages the drum at an area 14(FIG. 5) on it's outer body where a tension rod 6 meets a shell lug 5. As shown in FIG. 3, each outer band 1*a* carries a small opening 13 therein which engages an area on a drum's shell lug 5. As best shown in FIG. 17 and FIG. 18, the opening 13 in the outer band 1*a* is placed over and around a lug nut 11 which protrudes from a drum's shell lug 5 (FIG. 5) and acts as a guide for the opening 13 in the outer band 1*a*. As illustrated in FIG. 6, each sub-belt is stretched away from the annular frame 2 by it's segment's outer bands 1*a* in such a way as not to intersect with the belt's previously mentioned plane of attachment to said frame. Each sub-belt engages an opposing set of lugs attached to a drum's shell, an opposing set meaning all lugs 5 which receive tension rods 6 from a common counterhoop 7, and applies a force to each said set which pulls each set of opposing lugs toward the annular frame, and more importantly, toward each other. Thus, the drum shell acts as a counterpoise to each sub-belt and is supported in a state equilibrium by counterbalancing the opposing forces exerted upon it by the suspension belt as represented in FIG. 13.

To accommodate various sizes of drums having various hardware designs, the suspension belt 1 carries a proportionate number of segments, that is, the dimensions of the belt are proportional to the dimensions of a drum engaged therewith, much the way drumheads are of various diameters.

As seen in FIG. 2 and FIG. 11, an annular mounting frame 2 is a cylinder with a fixed diameter and is diametrically larger than that of a drum mounted therein so as to be in parallel circumferential relation with the outer shell of said drum. The cylinder is hoop-like in that it's cylindrical depth is considerable less than that of the drum mounted therein. The cylinder is rigid and has a plurality of holes 10 in and spaced around it's wall allowing the attachment of the before mentioned suspension belt 1 along and around the inner portion of said wall. The frame 2 is not adjustable such that a drum of a particular diameter requires it's own diametrically proportional annular frame.

Figure 1:
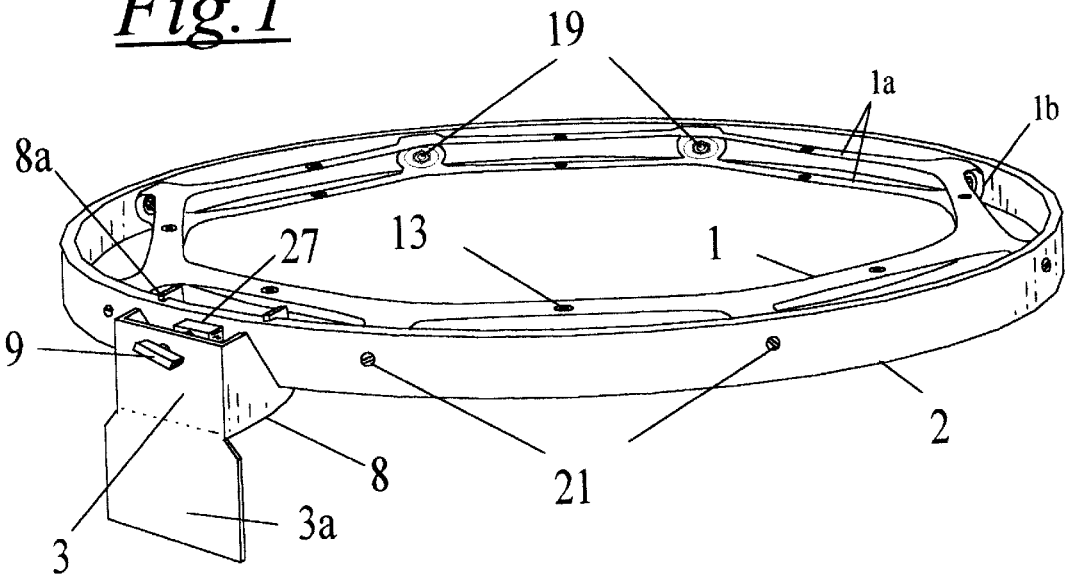
FIG. 1 is an elevated, frontal view of my invention showing it's mounting clamp, annular frame, and suspension belt.
Figure 14:
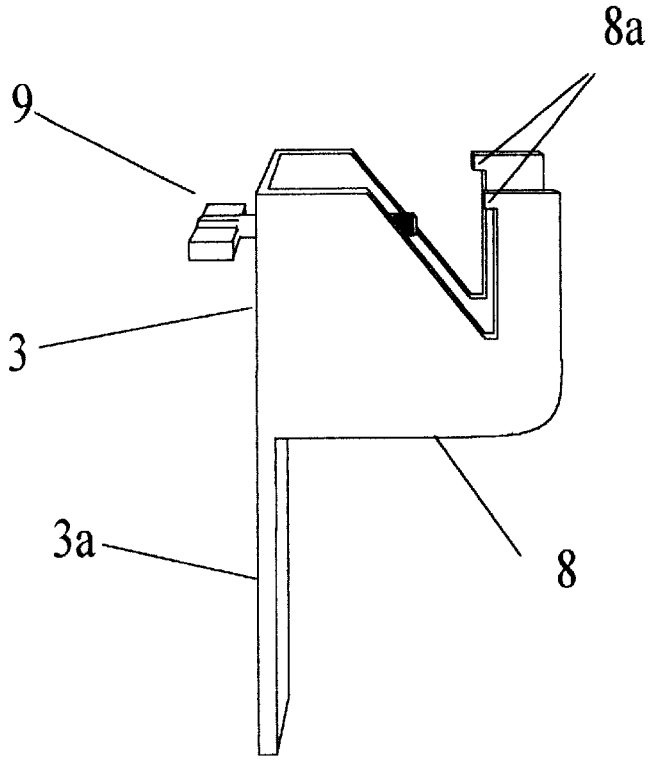
FIG. 14 is an elevated, frontal view of the mounting clamp.
Figure 15:
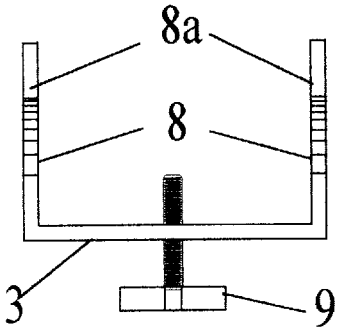
FIG. 15 is a partial, overhead view showing the mounting clamp's main plate, outward extending members, and main plate screw (protrusion is not clearly seen in this view)
Figure 16:
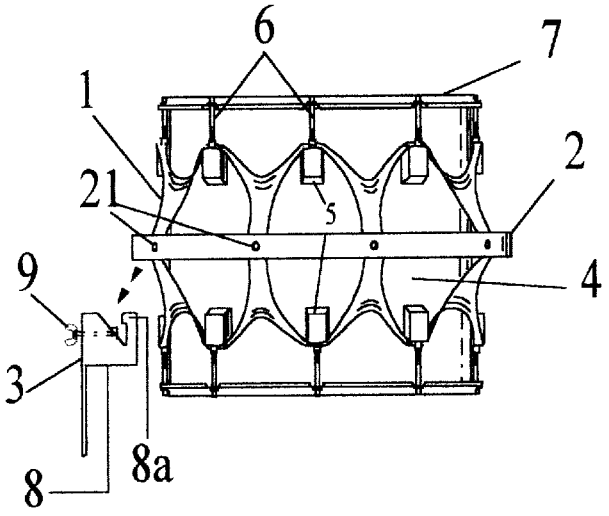
FIG. 16 is a partial, frontal view, similar to FIG. 2, showing the annular frame disengaged from the mounting clamp.

Shown in FIG. 1, a mounting clamp, having a pair of rigid, arm-like, members 8 fixed thereto and extending away from each edge of it's main plate 3, receives and supports the annular frame 2. As seen in FIG. 14 and FIG. 15, said members are in rigid relation with said plate and extend away from it's edges at a lower portion thereof before turning sharply upward. The upward extending portion of each member carries a small protrusion 8*a* at the top, inner-facing, portion thereof, inner-facing referring to the side of an upward extending member which is in closest relation with, and facing, the clamp's main plate 3. This protrusion 8*a* acts as a brace for the annular frame 2 and helps keep said frame in consistent relation with the clamp. The wall of the annular frame is placed into the area between the clamp's main plate 3 and arm-like members 8 and held in place by the protrusion 8*a*. A screw 9 or appropriate tensioning means extends from the clamp's main body 3 which applies pressure to the engaged annular frame 2 in such a way as to push said frame towards. against, and into rigid relation with the inner facing portion of the clamp's outward extended mounting arms 8. As seen in FIG. 16, drum may remain suspended, by the belt, in the annular frame when separated from the mounting clamp.

Figure 9:
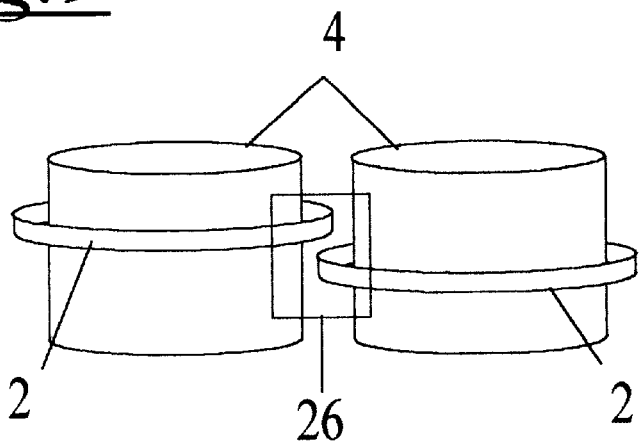
FIG. 9 is an elevated, frontal view of a representation in which two annular frames, used for two separate drums, overlap.

In regard to the attachment of the flexible belt to the annular frame and best described with FIG. 9 and FIG. 10, one embodiment would be that each inner band 1*b* may be attached at a point 25 along said band's length which is centered in the band to achieve an evenly supported drum, in other words, the plane of the encircling annular frame 2 is generally equidistant from, and parallel to, both openings of a drum's cylindrical shell 4, as seen in FIG. 2.

In another embodiment, the inner bands may be attached at off-centered points 24 so that a drum 4 may sit lower or higher respectively in the annular frame 2, that is, the plane of said frame 2 is not equidistant from, but still parallel to, said openings of drum's shell 4. This allows two mounted drums to be placed closely together such that each annular frame 2 slightly overlaps the other as depicted in the area 26 in FIG. 9. This is important for purposes of positioning a drum in a drum set where spacing is a concern.

Figure 7:
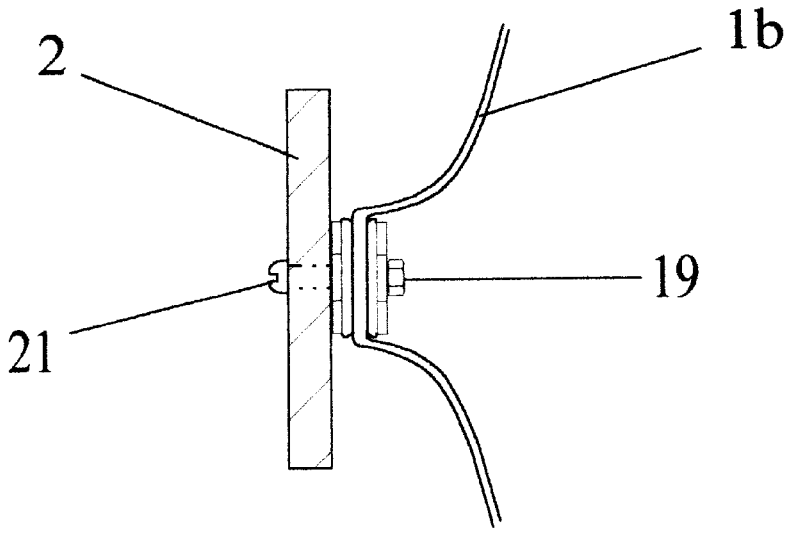
FIG. 7 is a cross sectional, side view of the annular frame's wall and one inner band and various components used for the attachment of the belt to the frame.
Figure 8:
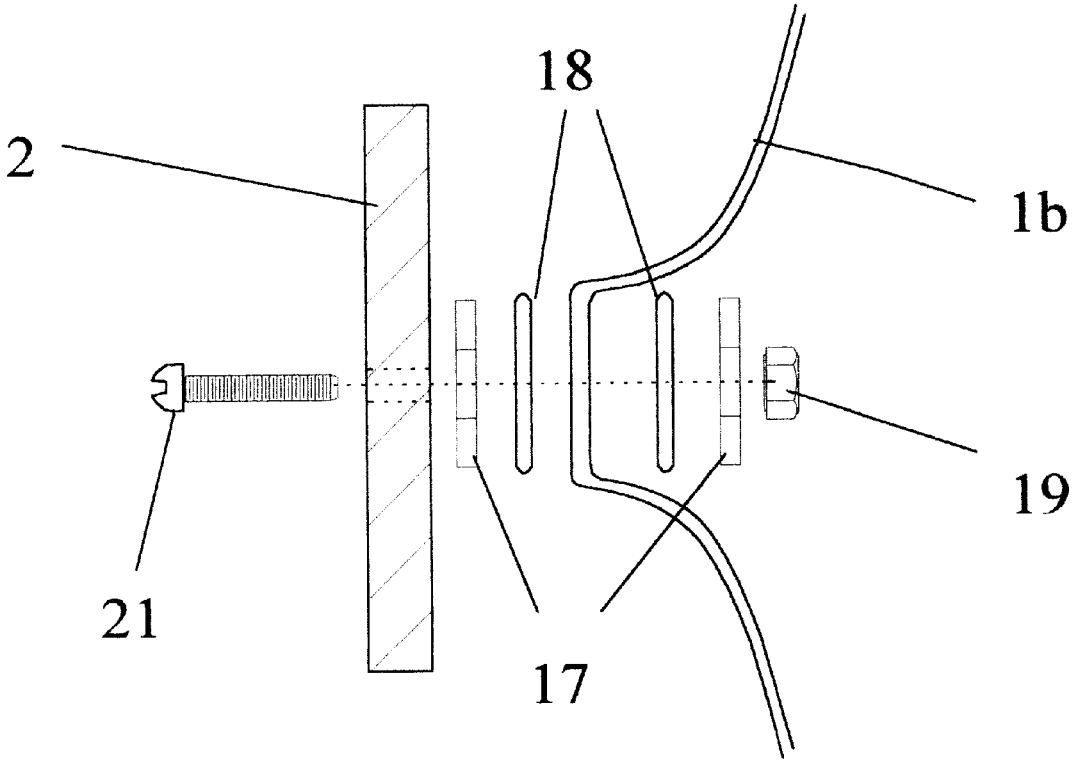
FIG. 8 is a cross sectional, exploded view similar to FIG. 7 showing the attachment components separated.

Concerning the flexible belt's mode of attachment to the annular frame by said belt's before mentioned inner bands, FIG. 8 offers a close view of a screw 21 which passes through on opening 10 in the wall of said frame 2 and receives a plurality of fixtures extending radially inward from said frame's inner wall in the following order: a washer 17, a flexible washer or gasket 18 to prevent slippage, the inner band 1*b* of the suspension belt, a second slippage preventing washer or gasket 18, a second washer 17, and a securing bolt 19. As seen in FIG. 7, the entire set of fixtures is squeezed together and secured to the frame 2 by tightening said bolt 19 onto said screw 21.

As described, my invention offers a unique and effective application for mounting a musical drum. The device allows a drum to be significantly separated from it's supporting structure so that the drum may retain it's resonating energy when played. The device offers a high degree of flexibility in that the described suspension belt, in conjunction with the annular frame supported by the mounting clamp, adjusts the position of a drum, engaged thereby, as to bring said drum back to a state of equilibrium each time it is struck with a drumstick or mallet, which takes a drum so mounted with the device out of said state momentarily. For this reason, the action of a beaten drum so engaged and supported by my invention is somewhat piston-like, but not so much as to significantly alter the conventional feel of the drumhead. In addition, my invention's mounting clamp receives and supports the described annular frame, with suspension belt and drum contained therein, by one relatively small localized area of said frame's body, this allows a mounted drum to extend fully away from a supporting structure, to which said clamp may be joined. The nature of my invention's application is functional and practical as described, however, certain modifications could be made to the device which would not alter the theme of it's application.

For example, a pressure plate 27 or the like, seen in FIG. 1 and FIG. 2, could be used in the mounting clamp which would be placed in such a way as to be between the tensioning screw 9 and the received annular frame 2 to prevent scaring or damage to the outer portion of said frame. Implementation of such a plate would not alter the application of the clamp as described. The main plate of the clamp, as seen in FIG. 14, carries an extension 3a to which an external supporting structure could be attached, however, this extension is not vital to the function of the clamp as described and this area of the clamp could be modified so as to make the clamp an integral part of in external supporting structure. Additionally, the inner portion of each of the clamp's upward extending members 8 may be cushioned so as to prevent scaring or damage to the inner portion of said frame which contacts said members.

Regarding the opening 13 carried by each of the suspension belt's described outer bands 1*a*, a grommet or the like could be used to reinforce the opening and this would not change the bands function.

Another modification could be made in regard to the suspension belt's mode of attachment to the annular frame. Various combinations and/or sequences of washers, anti-slip gaskets, and the like could be utilized in attaching the belt to the frame which could deviate from the method as offered herein, but would not alter the belt's function. What is important in my, invention is simply the attachment of the suspension belt's inner bands 1*b* to the cylindrical, annular frame 2

These and other subtle modifications that could be made to the device by those skilled in the art of such modifications would not change the basic function of my invention's application.

I claim:

1. A mounting apparatus for supporting a musical drum, comprising:

a flexible, elastic suspension belt having the form of a cylindrical wall when in a relaxed state, the belt further comprising a plurality of identical segments, the segments being characterized by centralized openings which divide the belt into sets of bands, comprising:

upper and lower outer sets of bands, each band carrying a central opening for engaging hardware fixtures on the outer body of a drum when the belt is in a tensioned position; and an inner set of bands which are centered in the belt's width, each adjacent segment sharing a common inner band, each inner band comprising a central attachment point;

a rigid annular mounting frame having the form of a cylindrical wall, comprising a plurality of openings therethrough for attaching to the suspension belt at said attachment points when the belt is in said tensioned position; and a mounting clamp comprising a flat, rigid main plate, with an opening centered therein in which a tensioning screw is implemented in perpendicular relation with said plate, the clamp further comprising two identical arms which extend away from the main plate and extend parallel to each other, each arm having a slot therethrough and an upper protrusion extending into said slot toward the main plate, said slot being for the purpose of receiving said annular frame and said protrusion acting as a brace for the annular frame, the annular frame being placed into or out of rigid relation with said arms by the tensioning screw.

2. The mounting apparatus of claim 1, wherein the belt is fashioned from a single piece of material.

3. The mounting apparatus of claim 1, wherein the belt is adapted to support a drum having a number of hardware fixtures equal to the number of segments carried by the belt.

4. The mounting apparatus of claim 1, wherein the frame is composed of a metallic material.

5. The mounting apparatus of claim 1, wherein the frame is composed of a plastic material.

6. The mounting apparatus of claim 1, wherein the frame is composed of wood.

7. The mounting apparatus of claim 1, wherein the frame is composed of a combination of at least two of the materials of a group consisting of metal, plastic and wood.

8. The mounting apparatus of claim 1, wherein the frame is adapted to support a drum diametrically smaller than the frame.

9. The mounting apparatus of claim 1, wherein the clamp is composed of a metallic material.

10. The mounting apparatus of claim 1, wherein the clamp is composed of a rigid plastic material, such that the clamp is strong enough to carry the weight of both the annular frame and drum supported therein.

11. The mounting apparatus of claim 1, wherein the attachment points on the belt's inner bands are not centered in relation to the belt's width.

* * * * *